US006406054B1

(12) United States Patent
Huyghe

(10) Patent No.: US 6,406,054 B1
(45) Date of Patent: Jun. 18, 2002

(54) GLIDING BOARD USED FOR ALPINE SKIING OR SNOWBOARDING

(75) Inventor: Christian Huyghe, Gruffy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/359,653

(22) Filed: Jul. 26, 1999

(30) Foreign Application Priority Data

Jul. 31, 1998 (FR) ..... 98 09966

(51) Int. Cl.[7] ..... A63C 5/00
(52) U.S. Cl. ..... 280/610; 280/609; 280/602
(58) Field of Search ..... 280/610, 601, 280/609, 602, 11.12, 607, 14.2, 14.21

(56) References Cited

U.S. PATENT DOCUMENTS

| | | | | | |
|---|---|---|---|---|---|
| 2,539,224 | A | * | 1/1951 | Beerli | 280/602 |
| 2,544,028 | A | * | 3/1951 | Kjellberg | 280/610 |
| 4,523,772 | A | * | 6/1985 | Arnsteiner | 280/610 |
| 5,033,765 | A | * | 7/1991 | Cagneux et al. | 280/602 |
| 5,199,734 | A | * | 4/1993 | Mayr | 280/602 |
| 5,303,948 | A | * | 4/1994 | Le Masson et al. | 280/607 |
| 5,332,252 | A | * | 7/1994 | Le Masson et al. | 280/602 |
| 5,435,588 | A | * | 7/1995 | Commier et al. | 280/602 |
| 5,695,209 | A | * | 12/1997 | Deborde et al. | 280/610 |
| 5,759,664 | A | * | 6/1998 | Chisnell et al. | 428/109 |
| 5,915,717 | A | * | 6/1999 | Faye | 280/602 |
| 6,105,991 | A | * | 8/2000 | Dodge et al. | 280/610 |

FOREIGN PATENT DOCUMENTS

| | | | | |
|---|---|---|---|---|
| DE | 4232444 | * | 4/1993 | 280/610 |
| DE | 4209992 | | 9/1993 | |
| FR | 2679820 | | 2/1993 | |
| FR | 2691638 | | 12/1993 | |

* cited by examiner

*Primary Examiner*—Robert P. Olszewski
*Assistant Examiner*—James S. McClellan
(74) *Attorney, Agent, or Firm*—Greenblum & Bernstein, P.L.C.

(57) ABSTRACT

A gliding board having a center core, a gliding sole, at least one lower reinforcing layer, and at least one upper reinforcing layer, the layers being positioned on both sides of the board. At least the upper reinforcing layer is formed of two strips that are different in nature each of which respectively extends, into the extension of the other from the central zone of the ski to each of its ends, the strips being different by the nature of the reinforcing material used or, in the case of two strips of resin reinforced with fibers, by the orientation of the fibers, or the basic weight of the fibers. In the case of a ski, the strips that are different in nature are superimposed in the central zone of the board and reinforce the zone of the ski where the mounting of retaining elements is provided.

17 Claims, 2 Drawing Sheets

1
2
3
4
5
5a
5b
6
7
8
10
11
14
15

GLIDING BOARD USED FOR ALPINE SKIING OR SNOWBOARDING

BACKGROUND OF THE INVENTION

1. Field of the Invention

The invention relates to a gliding board used for alpine skiing or snowboarding.

2. Description of Background and Relevant Information

In a manner known in the art, a board of the above-mentioned type is formed of a center core and of various reinforcing layers positioned above and below the core. Layers of glass fiber, carbon, or other materials embedded in the epoxy resin, or metal layers, notably aluminum alloy layers, are commonly used as a reinforcing layer.

Each of these reinforcing materials has well-defined properties. Thus, it is known that a ski having aluminum reinforcements has a soft contact with the snow, and that it absorbs terrain contours. A ski of this type is powerful and lays well on the snow. It is more adapted to downhill or giant slalom skiing.

On the other hand, a ski having fiber reinforcements is lively and responsive; it has a good rebound. This type of ski is adapted for bumps or sequences of short turns.

SUMMARY OF THE INVENTION

An object of the invention is to provide a gliding board, the performance of which is improved on snow in certain gliding phases.

The gliding board according to the invention has a center core, a gliding sole, at least one lower reinforcing layer, and at least one upper reinforcing layer, the layers being positioned on both sides of the board. The upper reinforcing layer of the gliding board of the invention is formed of two strips that are different in nature. Each of the strips respectively extends into the extension of the other, from the central zone of the ski to each of its ends, the strips being different by the nature of the reinforcing material used or, in the case of two strips of resin reinforced with fibers, by the orientation of the fibers, or the basic weight of the fibers.

According to an additional feature of the invention, in the case of a ski, the strips that are different in nature are superimposed in the central zone of the board and form a platform in the zone of the ski where the mounting of retaining elements is provided.

BRIEF DESCRIPTION OF DRAWINGS

The invention will be better understood with reference to the description below and to the annexed drawings that are an integral part of the description, in which.

DETAILED DESCRIPTION OF THE INVENTION

Figures 1, 2, 3, 4:
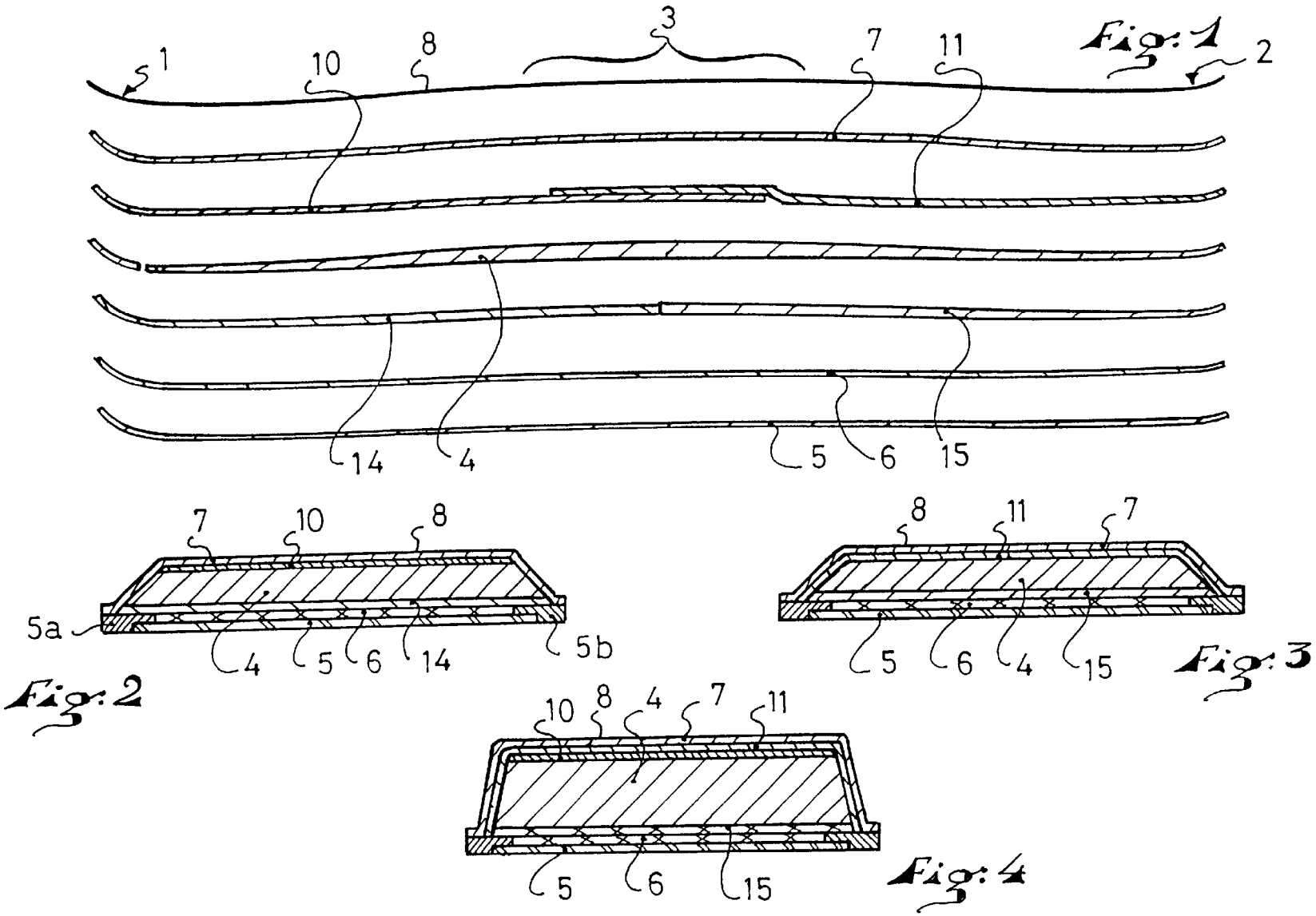
FIG. 1 shows a schematic exploded view of the structure of a ski according to a first embodiment of the invention.
FIG. 2 shows a transverse cross-sectional view of the forward section of the ski in FIG. 1.
FIG. 3 shows a transverse cross-sectional view of the rear section of the ski in FIG. 1.
FIG. 4 shows a transverse cross-sectional view of the central zone of the ski in FIG. 1.

The ski shown schematically in FIG. 1 has, in a manner known in the art, a tip or shovel 1, a tail 2, and a central zone

3 located near the middle. In a manner known in the art, this central zone is provided for mounting front and rear boot retention elements or, if applicable, an intermediate interface plate.

Because the invention is also applicable to snowboardss, FIG. 1 can alternatively be considered to schematically illustrate a snowboard.

The ski has a center core 4 that extends essentially along its entire length and that is surrounded by upper and lower reinforcing layers. The core 4 is of any appropriate type known in the art, such as wood, injection molded, or another type, and will not be described in detail. In particular, any arrangements that it may have at the shovel or tail are within the understanding of one skilled in the art.

Under the core, the ski has a gliding sole 5 with two lateral edges 5*a* and 5*b*. A lower reinforcing layer 6 extends above the sole. This layer extends in a continuous manner along the entire length of the ski. It is a layer of fibers, fiberglass, or carbon, impregnated with resin of the epoxy resin type.

Above, the ski has an upper reinforcing layer 7 also made of resin reinforced with fibers and, also above, one or more layers of decoration and protection 8 that extend along the entire length of the ski. The layer 8 is not shown as such in FIGS. 2 through 4. Preferably, as can be seen in FIGS. 2 through 4, these two layers 7 and 8 are folded down over the lateral sides of the ski and come down as far as the edges. It is also preferable that the two upper and lower reinforcing layers 6 and 7 are of the same nature for balancing the structure of the ski.

According to the invention, between the core and the upper reinforcing layer, i.e., above the neutral plane of the ski, the ski has an intermediate reinforcing layer formed by two distinct strips 10 and 11. Each of the strips respectively extends into the extension of the other from the shovel 1 or the tail 2 of the ski to the central zone 3. In this central zone, preferably, and as shown, the strips overlap. In this manner, in this zone, the structure of the ski is reinforced locally in the mounting zone of the retention elements. As shown in the drawing, the strips 10, 11 (as well as the other pairs of different strips disclosed herein) "extend into the extension of the other", or are "co-extensive", in the sense that they each occupy a common position within the cross section of the ski, at least in forward and rearward sections of the ski. Alternatively, For example, strip 10 is shown positioned in the forward cross section of FIG. 2 similarly to that of strip 11 in the rearward section of FIG. 3.

The strips 10 and 11 are different in nature. According to the embodiment illustrated, the strips are different in nature by the material used. One of the strips is made of resin reinforced with fibers, the other strip is formed by an aluminum alloy layer. The front strip 10 is a sheet of aluminum alloy, and the rear strip 11 is made of resin reinforced with fibers. Preferably, in the central zone of the ski, it is the resin reinforced strip that passes above the aluminum alloy strip. In the central zone of the ski, a layer of a viscoelastic material may be provided between the two ends of the strips 10 and 11. This layer would then be biased to shearing when the ski bends.

In a conventional manner, a metal reinforcing layer is generally in the form of a sheet without lateral folds coming down the length of the flanges; this is how the strip 10 is shown in FIGS. 2 and 4. On the contrary, a resin reinforcing layer may or may not have lateral folds along the flanges of the ski. FIGS. 3 and 4 show a strip 11 having two lateral folds located under the folds of the upper reinforcing layer 7. These folds could be omitted as well. In that case, the strip would cover only the upper surface of the core.

Preferably, under the core, the ski has strips of the same type as the strips 10 and 11, for balancing the structure of the ski. These strips are located under the neutral plane of the ski.

Thus, FIG. 1 shows two lower strips 14 and 15 located under the core, each in the extension of the other in the front and rear zones of the ski, respectively. Preferably, the strips 14 and 15 are of the same thickness. The lower strip 14 located under the strip 10 is also a sheet of aluminum alloy. The lower strip 15 located under the strip 11 is a resin reinforced with fibers. The two lower strips 14 and 15 meet in the central zone of the ski but do not overlap, according to the embodiment illustrated. Additional cut outs can be obtained in this area, so that the ends of the strips fit one into the other, for ensuring relative continuity while avoiding excessively violent stress jumps.

Assembly of the structure described above is done according to a conventional process. In a manner known in the art, the reinforcing layers of resin reinforced with fibers are fabrics pre-impregnated with resin and, in hardening, the resin also ensures the gluing of the layer when the ski is cured. Metal reinforcing strips, for their part, are assembled by means of additional thermofusible adhesive films that are inserted between the rear reinforcing layers 11 and 15 and the core.

Figure 5:
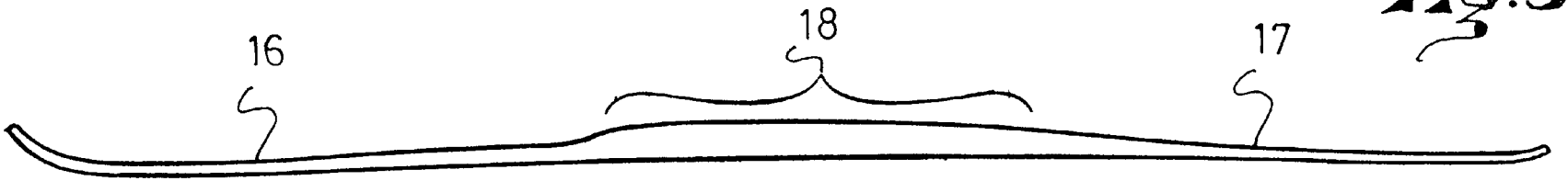
FIG. 5 illustrates another embodiment.

FIG. 5 shows the ski in FIG. 1 after assembly of the various layers. The front part 16 of the ski is thinner than the rear part 17 and the central zone 18. This derives from the fact that, in order to balance the flexibility of the front and rear zones of the ski, the top and bottom metal reinforcing strips are closer to the neutral plane than the fiber reinforcing strips. In other words, in order to balance the flexibility of the front and rear zones of the ski, it is possible to play on the thickness of the reinforcing strips and/or the thickness of the ski, i.e., the spacing of the strips with respect to the neutral plane.

For a ski of this type, it is thought that the presence of metal alloy reinforcing strips in the forward area facilitates the passage of the ski on terrain contours. Furthermore, the presence of reinforced resin reinforcing strips at the rear provides a rebound when exiting turns.

The performance of the ski is modified in the sense that it is more responsive in exiting turns and/or more stable on straightaways with respect to a conventional ski having a completely metal or completely fiber reinforcing structure.

The arrangement relating to the strips is not limiting, however, and, to the contrary, it is possible to provide fiber reinforced resin reinforcing strips on the front of the ski, and metal alloy reinforcing strips on the back. A ski of this type would be easy to actuate upon entering a turn, and it would provide good recovery upon exiting a curve, and powerful support.

Figure 6:
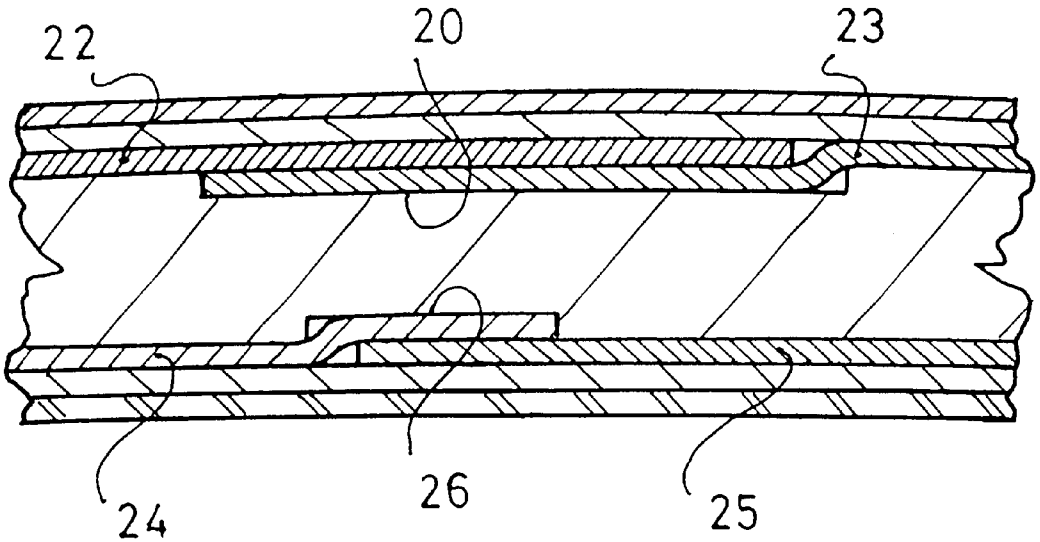
FIG. 6 illustrates another embodiment.

FIG. 6 shows a variation of the foregoing embodiments of the invention. According to this variant, the core has an encasement 20 in its upper part. The encasement extends in the overlapping zone of the strips 22 and 23. Its depth is provided for housing the end of one of the strips so that they have an upper surface that is substantially continuous in this zone.

FIG. 6 shows an encasement 26 located in the lower part of the core, which is provided for the overlapping of the strips 24 and 25.

The invention is not limited to the invention described, and other embodiments are possible.

Specifically, the reinforcing strips can differ by the nature of the fibers, for example, glass fibers, on the one hand, and carbon fibers, on the other hand, carbon fibers having the characteristic of being even more responsive than glass fibers. Reinforcing strips having different fiber orientations could also be used, for example, in one case having fibers oriented longitudinally, and in the other case diagonally. The fiber layers could also be made different by the basic weight of the reinforcing strips, i.e., the proportion of fibers by weight. Other variants could be implemented, the general idea of the invention being to make the rigidity and responsiveness of the front and rear parts of the ski different. In a general sense, the reinforcing strips 10, 11, or 14, 15, or 22, 23, or 24, 25, e.g., can be considered to be "structurally different from each other". In any case, preferably, strips of the same nature are used above and below the core, respectively toward the shovel and the tail of the ski.

It is evident that the invention applies similarly to any type of gliding board, particularly snowboarding The instant application is based upon French Patent Application No. 98 09966, filed Jul. 31, 1998, the disclosure of which is hereby incorporated by reference thereto in Its entirety, and the priority of which is hereby claimed under 35 USC 119.

What is claimed is:

1. A gliding board comprising:

a tip at a front end of the gliding board, a tail at a rear end of the gliding board, and a longitudinally extending central zone between said tip and said tail;

a core extending from said tip rearwardly to said tail;

a gliding sole;

at least one lower reinforcing layer located beneath said core;

at least one upper reinforcing layer located above said core;

said upper reinforcing layer comprising two structurally different strips, said two strips being longitudinally coextensive at least from said tip to said central zone and from said tail to said central zone.

2. A gliding board according to claim 1, wherein:

the gliding board is an alpine ski having a width at least in said central zone to accommodate a single longitudinally extending boot.

3. A gliding board according to claim 1, wherein:

the gliding board is a snowboard having a width at least in said central zone to accommodate a pair of transversely extending boots.

4. A gliding board according to claim 1, wherein:

said two strips are structurally different in terms of the reinforcing material of which said two strips are comprised.

5. A gliding board according to clam 4, wherein:

a first of said two strips comprises metal and a second of said two strips comprises fiber-reinforced resin.

6. A gliding board according to claim 5, wherein:

said metal comprises an aluminum alloy.

7. A gliding board according to claim 5, wherein:

said first of said two strips is positioned at least between said tip and said central zone and said second of said two strips is positioned at least between said tail and said central zone.

8. A gliding board according to claim 5, wherein:

said first of said two strips is positioned at least between said tail and said central zone and said second of said two strips is positioned at least between said tip and said central zone.

9. A gliding board according to claim 5, wherein:

said second of said two strips overlies said first of said two strips in said central zone.

10. A gliding board according to claim 1, wherein:

said at least one upper reinforcing layer constitutes a first upper reinforcing layer;

a second upper reinforcing layer is located above said core.

11. A gliding board according to claim 10, wherein:

said second upper reinforcing layer is located above said first upper reinforcing layer.

12. A gliding board according to claim 10, wherein:

a decoration layer is positioned above said first and second reinforcing layers.

13. A gliding board according to claim 1, wherein:

said lower reinforcing layer comprising two structurally different strips, said two strips being longitudinally coextensive at least between said tip to said central zone and between said tail and said central zone.

14. A gliding board according to claim 1, wherein:

said core comprises an longitudinally extending encasement;

a first of said two strips has a rearward end portion and a second of said two strips has a forward end portion, said rearward end portion of said first of said two strips and said forward end portion of said second of said two strips overlap within said encasement.

15. A gliding board comprising:

a longitudinally extending central zone to be positioned beneath a boot mounted upon the gliding board, a forward zone extending longitudinally forward of said central zone ending at a tip, a rearward zone extending longitudinally rearward of said central zone ending at a tail;

a core extending from said tip rearwardly to said tail;

a gliding sole;

at least one lower reinforcing layer located beneath said core;

at least one upper reinforcing layer located above said core;

said upper reinforcing layer comprising two structurally different strips, said two strips being longitudinally coextensive at least in said forward zone and in said rearward zone.

16. A gliding board comprising:

a tip at a front end of the gliding board, a tail at a rear end of the gliding board, and a longitudinally extending central zone between said tip and said tail, said central zone having a length to accommodate a mounting of a boot retention element;

the gliding board further comprising a plurality of vertically superposed layers, said layers comprising:

at least one decoration layer;

a core positioned beneath said decoration layer and extending from said tip rearwardly to said tail;

a gliding sole positioned beneath said core;

at least one upper reinforcing layer in a vertically determinate position above said core, said upper reinforcing layer comprising two structurally different longitudinally co-extensive strips, a first of said two strips occupying said vertically determinate position above said core in a portion of the gliding board forward of said central zone and a second of said two strips occupying said vertically determinate position above said core in a portion of the gliding board rearward of said central zone; and at least one lower reinforcing layer located beneath said core.

17. A gliding board comprising:

a tip at a front end of the gliding board, a tail at a rear end of the gliding board, and a longitudinally extending central zone between said tip and said tail;

a core extending from said tip rearwardly to said tail;

a gliding sole;

at least one lower reinforcing layer located beneath said core;

at least one upper reinforcing layer located above said core;

said upper reinforcing layer comprising a longitudinally extending forward portion and a longitudinally extending rearward portion, said forward and rearward portions of said upper reinforcing layer being longitudinally coextensive at least from said tip to said central zone and from said tail to said central zone, said forward and rearward portions of said upper reinforcing layer comprising means for making a rigidity and responsiveness of a longitudinally extending front part of the gliding board different from a rigidity and responsiveness of a longitudinally extending rear part of the gliding board.

* * * * *